US009533310B2

(12) United States Patent
Dumpor et al.

(10) Patent No.: US 9,533,310 B2
(45) Date of Patent: Jan. 3, 2017

(54) ADVANCED SYSTEM RECOVERY FOR FEED SYSTEM

(71) Applicant: Altec Industries, Inc., Birmingham, AL (US)

(72) Inventors: Zlatko Dumpor, Raleigh, NC (US); Vlad P. Patrangenaru, Columbia, MD (US)

(73) Assignee: Altec Industries, Inc., Birmingham, AL (US)

( * ) Notice: Subject to any disclaimer, the term of this patent is extended or adjusted under 35 U.S.C. 154(b) by 96 days.

(21) Appl. No.: 14/171,525

(22) Filed: Feb. 3, 2014

(65) Prior Publication Data

US 2015/0217302 A1 Aug. 6, 2015

(51) Int. Cl.
*B02C 25/00* (2006.01)
*B02C 18/22* (2006.01)

(52) U.S. Cl.
CPC ..... *B02C 25/00* (2013.01); *B02C 18/2225* (2013.01); *B02C 18/2283* (2013.01)

(58) Field of Classification Search
CPC ..... B02C 25/00; B02C 13/286
USPC ..... 241/34–36, 92, 222, 224
See application file for complete search history.

(56) References Cited

U.S. PATENT DOCUMENTS 5,088,532 A * 2/1992 Eggers ..... B27L 11/002 144/176
5,718,163 A * 2/1998 Termini ..... A47J 42/44 241/34
6,572,037 B1 * 6/2003 Bendzick ..... B02C 18/142 241/166
6,814,320 B1 * 11/2004 Morey ..... A01G 3/002 241/34
7,011,258 B2 3/2006 O'Halloran et al.
7,040,558 B2 5/2006 Stelter et al.
7,044,409 B2 5/2006 Stelter et al.
7,232,083 B2 6/2007 Stelter et al.
7,441,718 B2 * 10/2008 Seaman ..... B02C 18/2283 241/34
7,597,279 B1 10/2009 Stelter et al.
7,624,937 B2 12/2009 Stelter et al.
7,637,444 B2 12/2009 Stelter et al.
7,654,479 B2 2/2010 Stelter et al.
8,684,291 B2 * 4/2014 Galloway ..... A01G 3/002 241/34

(Continued)

*Primary Examiner* — Faye Francis
(74) *Attorney, Agent, or Firm* — Erise IP, P.A.

(57) ABSTRACT

A feed system for a woodchipper including a material-interface member for feeding material into a chipping mechanism of the woodchipper, an actuator for moving a material-interface member into interfacing and non-interfacing positions with the material, a sensor for detecting an operational parameter of the woodchipper, and a controller to direct the actuator. The controller operates by receiving the operational parameter of the woodchipper, establishing a normative operating value, and determining if the woodchipper is a first status or a second status based on a comparison between the operational parameter and the normative operating value. If the woodchipper is a first status, the controller instructs the actuator to move the material-interface member into the interfacing position. If the woodchipper is a second status, moving the material-interface member into a non-interfacing position.

16 Claims, 9 Drawing Sheets

(56) References Cited

U.S. PATENT DOCUMENTS

| | | | | |
|---|---|---|---|---|
| 2004/0112999 | A1* | 6/2004 | Byram | B02C 13/286 241/34 |
| 2007/0108323 | A1* | 5/2007 | Chapman | A01G 3/002 241/30 |
| 2007/0199613 | A1* | 8/2007 | Bouldin | B09B 3/00 141/73 |
| 2010/0001107 | A1* | 1/2010 | Kallenbach | B02C 18/2283 241/34 |
| 2010/0001108 | A1 | 1/2010 | Stelter et al. | |
| 2010/0163656 | A1 | 7/2010 | Stelter et al. | |
| 2011/0006142 | A1* | 1/2011 | Galloway | A01G 3/002 241/28 |
| 2012/0043404 | A1* | 2/2012 | Morey | B02C 25/00 241/25 |
| 2014/0163741 | A1* | 6/2014 | Morey | B02C 18/2291 700/275 |
| 2014/0209721 | A1* | 7/2014 | Kennedy | B02C 18/2283 241/30 |

* cited by examiner

ADVANCED SYSTEM RECOVERY FOR FEED SYSTEM

BACKGROUND

1. Field

Embodiments of the invention relate to woodchippers for chipping wood, brush, and other fibrous material. More particularly, embodiments of the invention relate to a feed system with a material-interface member movable into an interfacing position and a non-interfacing position with the material dependent on an operational parameter of the woodchipper.

2. Related Art

Many woodchippers have feed systems that assist in feeding material to be chipped towards and into a chipping mechanism. Some woodchipper designs include multiple feed rollers that cooperatively rotate to grasp the material and push it through the feed system and to the chipping mechanism. Other woodchipper designs include a single upper feed wheel or dual feed wheel system where the upper feed wheel pivots downwards towards the material and rotates about a horizontal axis to push the material towards the chipping mechanism. The feed rollers or feed wheel, both of which interface with the material, continuously operate while the woodchipper is powered on. This continuous operation is sometimes undesirable, however, if the chipping mechanism is stalled or otherwise operating poorly. The material also may become stuck and not able to be pushed forward into the chipping mechanism. This stopping of the material, sometimes called wood chocking, requires significant downtime to turn off the woodchipper and free the wood-chocked material.

SUMMARY

A feed system for a woodchipper in accordance with a first embodiment of the invention comprises a material-interface member for feeding material to be chipped, an actuator for moving said material interface member, a sensor for detecting an operational parameter of the woodchipper, and a controller for directing operation of the actuator based on said operational parameter. The material-interface member is movable into both an interfacing position and a non-interfacing position with the material. As described herein, the non-interfacing position includes the following positions or operation of the material-interface member: the material-interface member not touching the material, no longer pushing the material (including no longer applying pressure against the material), or not resting against the material; ceasing movement, including ceasing downward movement, of the material-interface member; or moving the material-interface member upwards and away from the material. In contrast, the interfacing position includes the following positions or operation of the material-interface member: the material-interface member touching the material, pushing the material (including applying pressure against the material), or resting against the material; or moving the material-interface member downwards and towards the material.

The controller is programmed with a first status and a second status respectively representing whether the woodchipper is operating normally or is struggling to chip the material. The controller is also programmed with a normative operating value that is compared against the operational parameter to determine the first status or the second status. Based on the result of the comparison, the controller instructs the material-interface member into one of the interfacing or non-interfacing positions.

A feed system for a woodchipper in accordance with a second embodiment of the invention comprises a feed wheel, a hydraulic cylinder for moving said feed wheel, a sensor associated with the woodchipper to sense a rotational parameter of the drum, and a controller for directing the hydraulic cylinder based on said rotational parameter. The feed wheel is moveable into an interfacing position and a non-interfacing position with material to be chipped. The controller has a first status and a second status determined by comparing the operational parameter to a normative operating value.

A method for feeding material into a woodchipper in accordance with a third embodiment of the invention comprises the steps of receiving an operational parameter of the woodchipper, establishing a normative operating value for the operational parameter, determining if the operational parameter is a first status or a second status, and instructing an actuator to move a material-interface member based on the determined status. In particular, if the operational parameter is the first status, the woodchipper is operating normally; in contrast, if the operational parameter is the second status, the woodchipper is struggling to operate, i.e., the woodchipper is stalling, operating at a decreased speed, or other similar deficient operating value. If the operational parameter is the first status, then the controller instructs the material-interface member to move into the interfacing position with material to be chipped. If the operational parameter is the second status, then the controller instructs the material-interface member to move into the non-interfacing position with material to be chipped.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
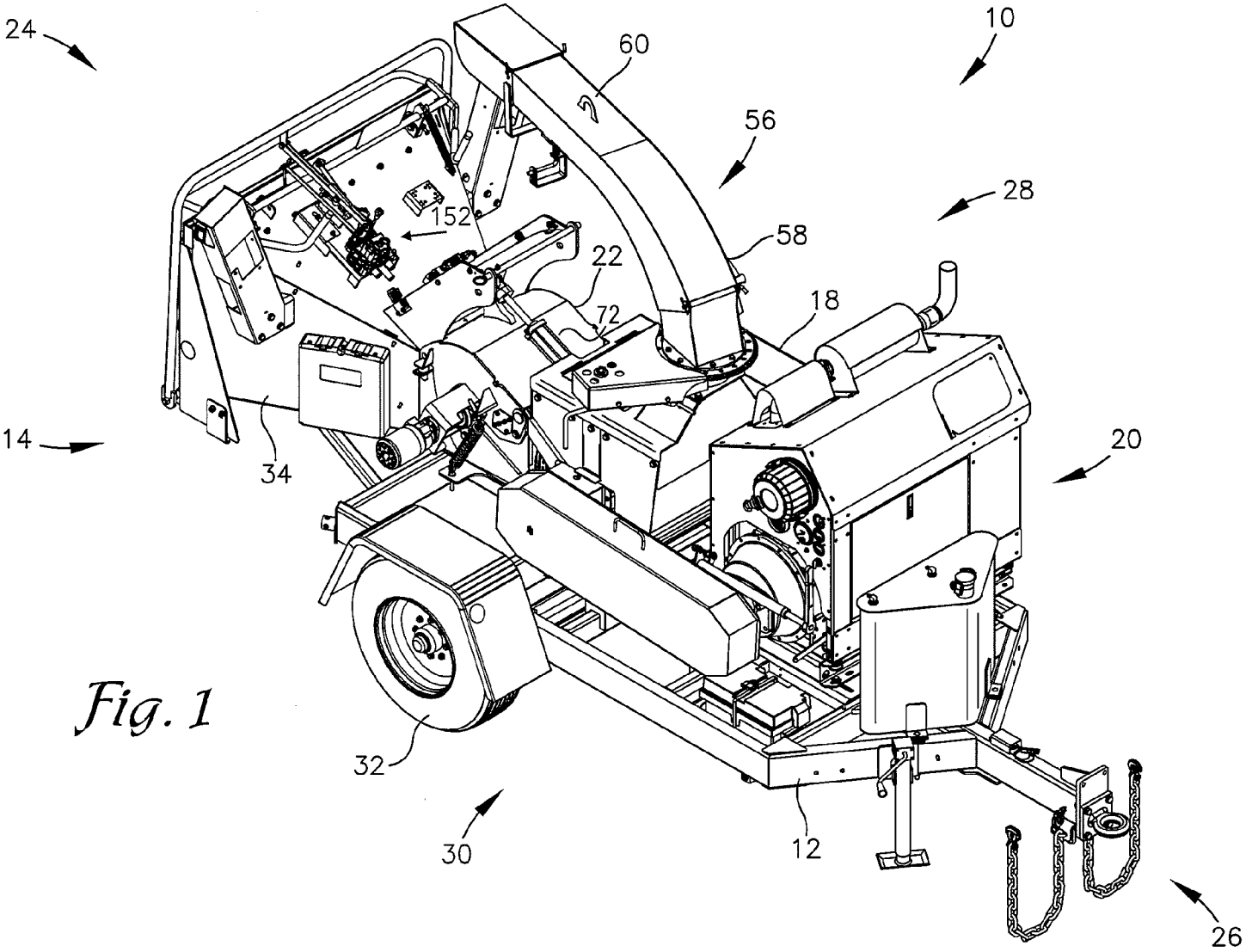
FIG. 1 is a perspective view of a woodchipper in accordance with various embodiments of the invention.

The drawing figures do not limit the current invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the figures, and particularly FIG. 1, embodiments of the invention relate to woodchippers for chipping or cutting fibrous material, such as wood and brush. The woodchipper 10 broadly comprises a frame 12, a feed inlet 14 for receipt of material to be chipped, a material outlet 16 through which chipped material exits, a chipping mechanism 18 disposed between the feed inlet and the material outlet and mounted on the frame, a power source 20 for driving the chipping mechanism, and a feed system 22 for feeding material to the chipping mechanism. Embodiments of the invention provide a feed system 22 that prevents wood chock during the feeding of the material into the chipping mechanism 18 by recognizing when the woodchipper 10 is operating outside of a pre-established operating value and, in response, controlling a speed of the chipping mechanism to prevent stalling of the chipping mechanism.

Figure 2:
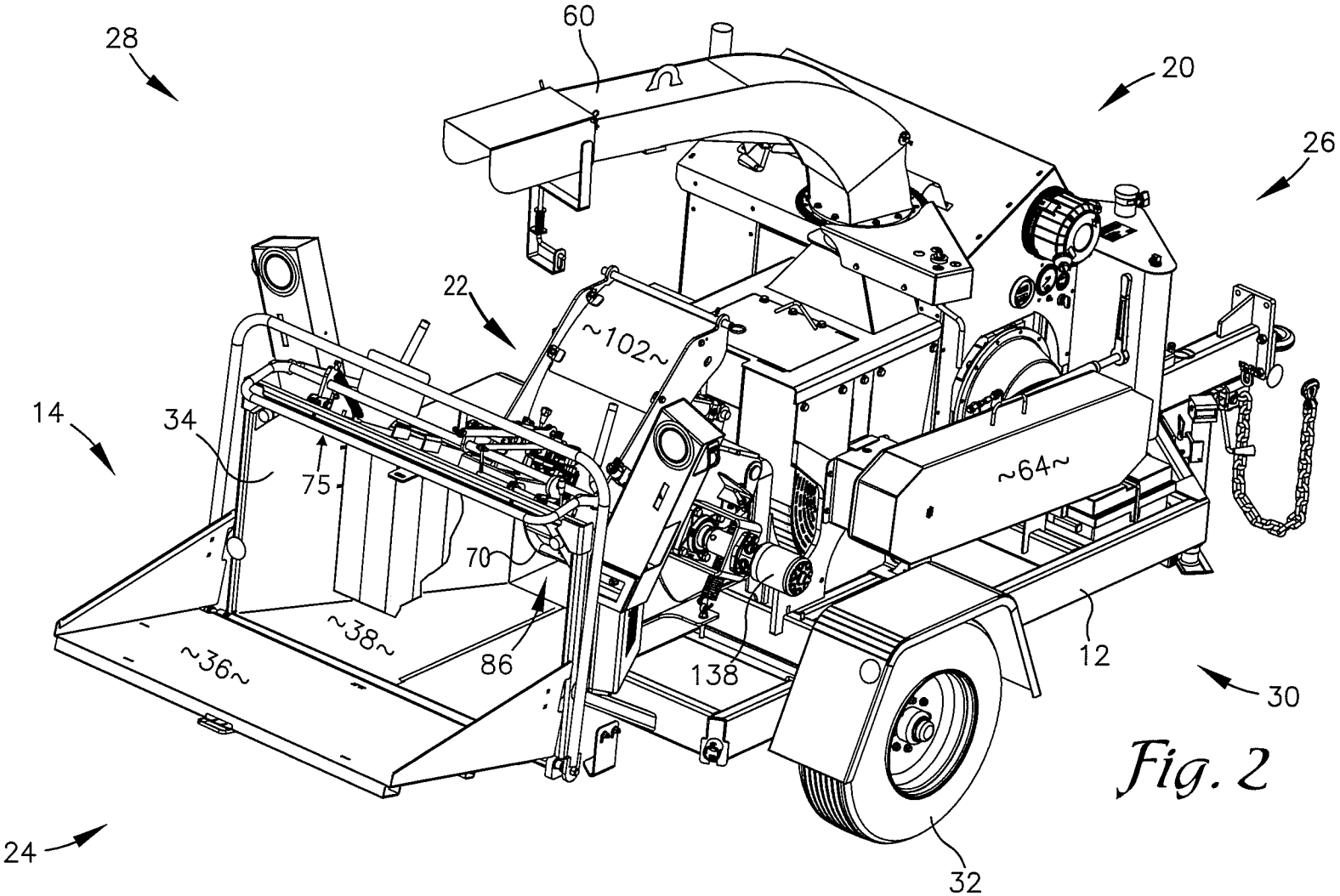
FIG. 2 is a perspective view of the woodchipper as seen from a feed inlet end of the woodchipper.

Referring to FIGS. 1 and 2, the woodchipper presents a feed inlet end 24 and a material outlet end 26. The feed inlet end 24 is positioned proximate the feed inlet 14, and the material outlet end 26 is positioned proximate the material outlet 16, such that material is fed from a rear of the chipper and exits towards a front of the chipper. Left 28 and right sides 30 of the woodchipper are identified when viewing the woodchipper from the feed inlet end 24, such that the left side is a street or driver side, and the right side is a passenger or curb side when the woodchipper is being towed by a vehicle.

Referring now to FIG. 1, the frame 12 provides a support for the other components of the woodchipper. In particular, the feed inlet 14, material outlet 16, power source 20, chipping mechanism 18, and feed system 22 are mounted on the frame 12. In embodiments, the frame 12 is made of metal or other rigid material configured to withstand the weight of the mounted components. The frame 12 may be formed of welded materials and may have wheels 32 mounted on a bottom of the frame to provide for the frame, and thus, the woodchipper 10, to be towed or otherwise transportable.

Referring to FIG. 2, the feed inlet 14 comprises a feed horn 34 and a feed table 36 pivotably attached to the feed horn. The feed horn 34 guides or channels the material into the feed system 22 and serves as a guard to prevent items not to be chipped from being caught by the feed system. The feed horn 34 is made of sheet metal or suitable material and includes four adjoining sides that are angled outwards towards the feed inlet end 24 to present an opening through which the material is fed.

The feed table 36 provides a support structure for material being inserted through the feed horn 34 and to the feed system 22. Referring to FIGS. 1 and 2, the feed table 36 is pivotably attached to the feed horn 34 at a bottom 38 of the feed horn, such that the feed table is pivotable approximately ninety degrees towards the opening of the feed horn. When in use, the feed table 36 may be rotated downwards, as shown in FIG. 2, and when not in use, such as during transport of the woodchipper 10, the feed table 36 may be rotated upwards and secured to the feed horn 34.

Figure 3:
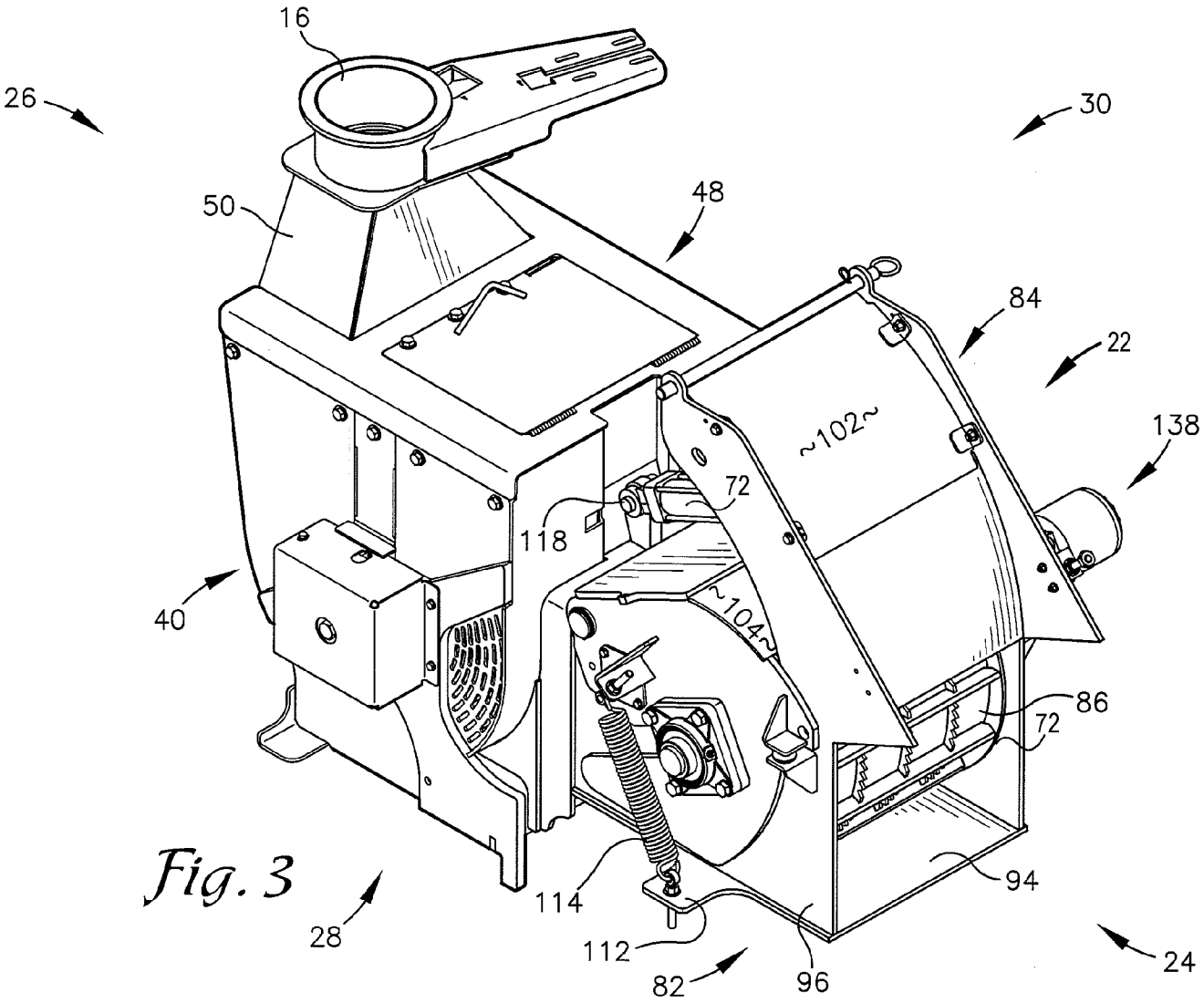
FIG. 3 is a perspective view of a feed system and a chipping mechanism of the woodchipper.
Figure 4:
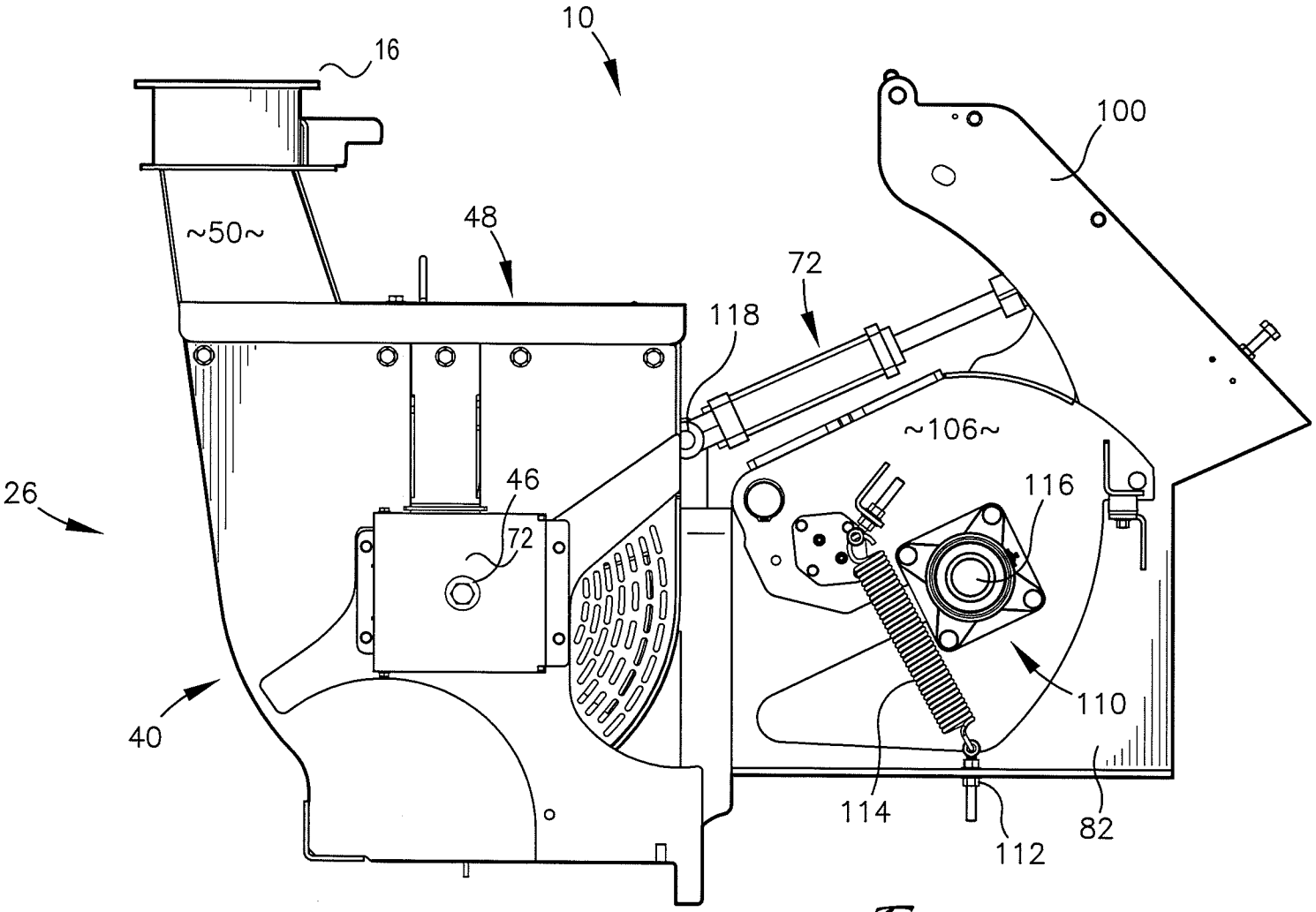
FIG. 4 is a side view of the feed system and chipping mechanism of the wood chipper.
Figure 5:
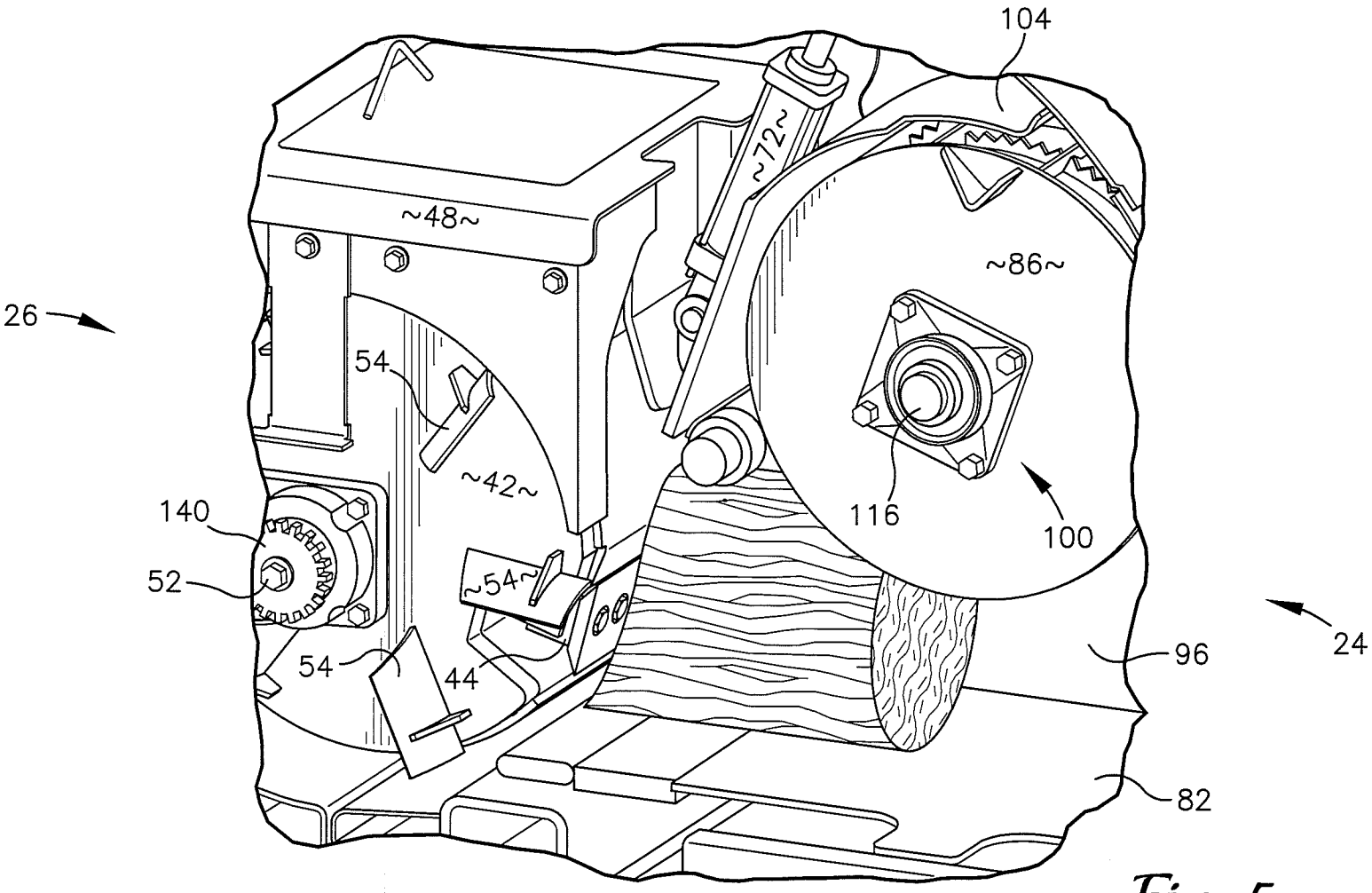
FIG. 5 is a fragmentary sectional view of the feed system and chipping mechanism of the wood chipper.

Referring to FIGS. 3-5, the chipping mechanism 18 comprises a drum housing 40 mounted to the frame 12 of the woodchipper 10, a drum 42 located within the drum housing and operable to rotate within the drum housing, and at least one chipping implement 44 coupled to the drum. In embodiments, the drum housing 40 is generally arcuate shaped, and, in particular, U-shaped, to receive the drum 42. Circular openings 46 are formed in the left 28 and right sides 30 of the drum housing 40 to mount the drum 42 within the drum housing, as described below. A top of the drum housing 40 is covered by an upper drum housing 48 that includes a funnel 50 through which chipped material is conveyed from the drum housing 40 and to the material outlet 16, as also described in more detail below.

The drum 42 is generally cylindrically shaped and includes a drum axle 52 horizontally oriented through the drum 42. The drum axle 52 is fed through the circular openings 46 in the drum housing 40 to mount the drum 42 within the drum housing. The drum axle 52 is then operable to freely rotate within the circular openings 46 of the drum housing 40. The drum axle 52 may be coupled with one or more bearings (not shown) to assist in rapid rotation of the drum axle and, in turn, the drum 42.

The chipping implement 44 comprises a plurality of blades, teeth, or other implements for chipping and cutting the material fed through the woodchipper 10. As shown in FIG. 5, the chipping implements 44 are mounted on the drum 42 at a plurality of annular positions with respect to the drum. As the drum 42 rotates within the drum housing 40, the chipping implement 44 chips the material, which falls within a hollow chamber inside the drum. The chipped material is then pushed towards each side of the drum 42 via the rotation of the drum. A plurality of vanes 54 is mounted on each side of the drum 42 to catch the chipped material and throw the material towards the funnel 50 of the upper drum housing 40.

Now turning to FIG. 3, the material outlet 16 is generally a chute 56. The chute 56 is coupled to and extends generally vertically upwards from the funnel 50 of the upper drum housing 48. In embodiments, the chute 56 includes a generally vertically-elongated section 58 integrally connected to a generally horizontal section 60, such that the chute extends vertically upwards along the vertically-elongated section and then curves generally horizontally along the horizontal section. The chute 56 length and shape allows for the chute to direct chipped material away from the woodchipper 10. As described above, the plurality of vanes 54 mounted to the drum 42 of the chipping mechanism 18 throws chipped material up through the funnel 50 and through the chute 56. In embodiments, the chute 56 may be rotatably connected to the top of the upper drum housing 48 to allow an operator to direct the flow of chipped material away from the woodchipper 10 and to a desired receptacle or location.

The power source 20 is comprised of a power component 62 and a drive system 64. The power component 20 may be an internal combustion engine or an electric motor. The power component 20 is mounted to the frame 12 of the woodchipper 10. In other embodiments, the power component 20 may be a power takeoff similar to that disclosed in U.S. patent application Ser. No. 13/836,522, filed Mar. 15, 2013, entitled "Apparatus and System for a Towed Device Powered by a Tow Vehicle," and which is owned by the assignee and applicant of the present application and is incorporated by reference herein in its entirety.

Figure 7:
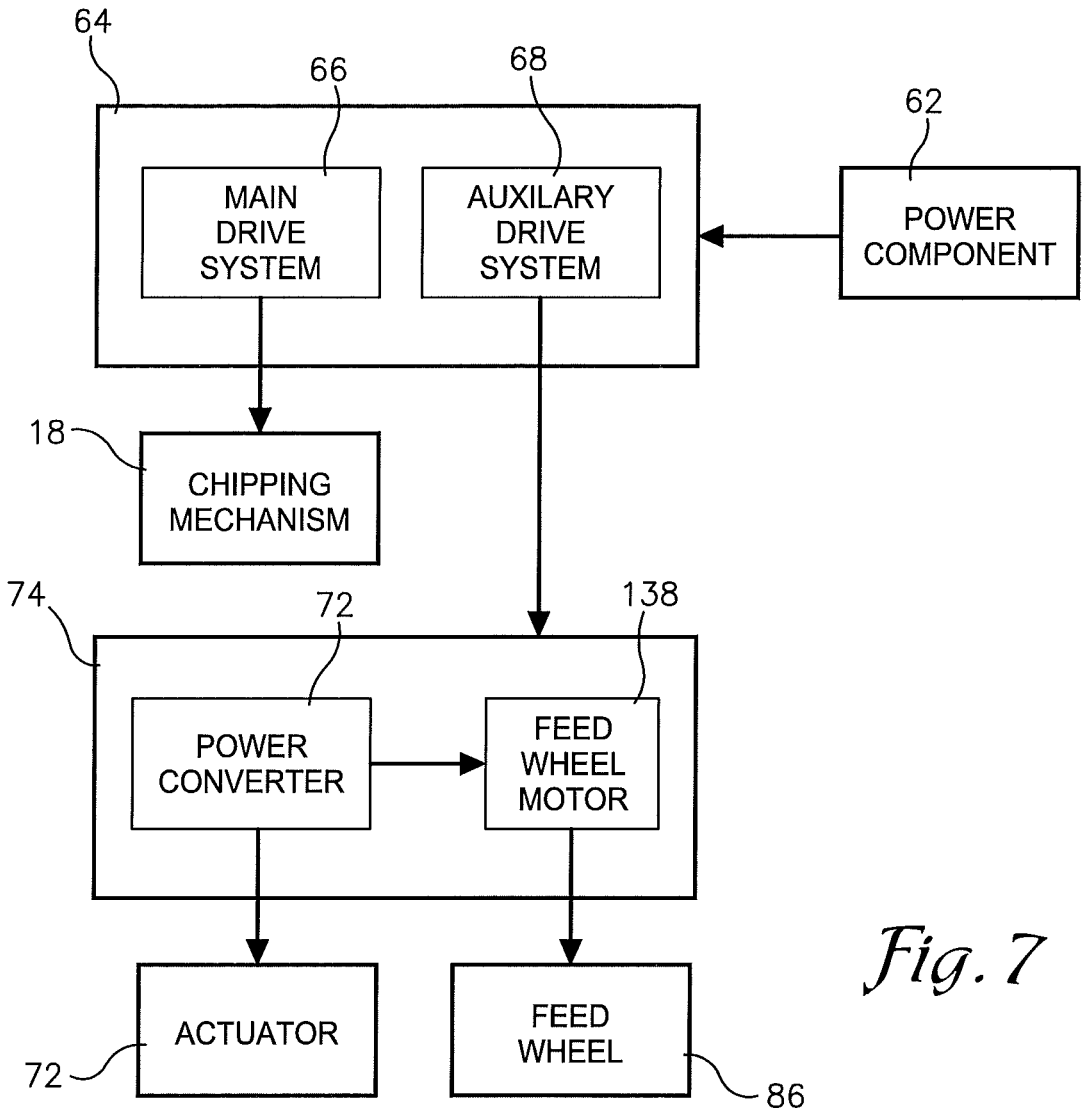
FIG. 7 is a block diagram showing the flow of power through the woodchipper.

As illustrated in FIG. 7, the drive system 64 comprises a main drive system 66 and an auxiliary drive system 68. The drive system 64 may further comprise a clutch (not shown) to allow temporary coupling/decoupling of the power source 20 and the chipping mechanism 18. In embodiments of the invention, the drive system 64 may include a mechanical flywheel (not shown) or other similar component for storing energy and providing the stored energy as needed. The main drive system 66 is operatively connected directly to the chipping mechanism 18. In other embodiments the main drive system 66 is connected indirectly through a series of belts, shafts, or a hydrostatic drive system (not shown). The main drive system 66 or the auxiliary drive system 68 may be operatively connected to power additional mechanisms (e.g., lights, batteries, alternators, etc.). The auxiliary drive system 68 powers the feed system 22, as further described below.

Figure 11:
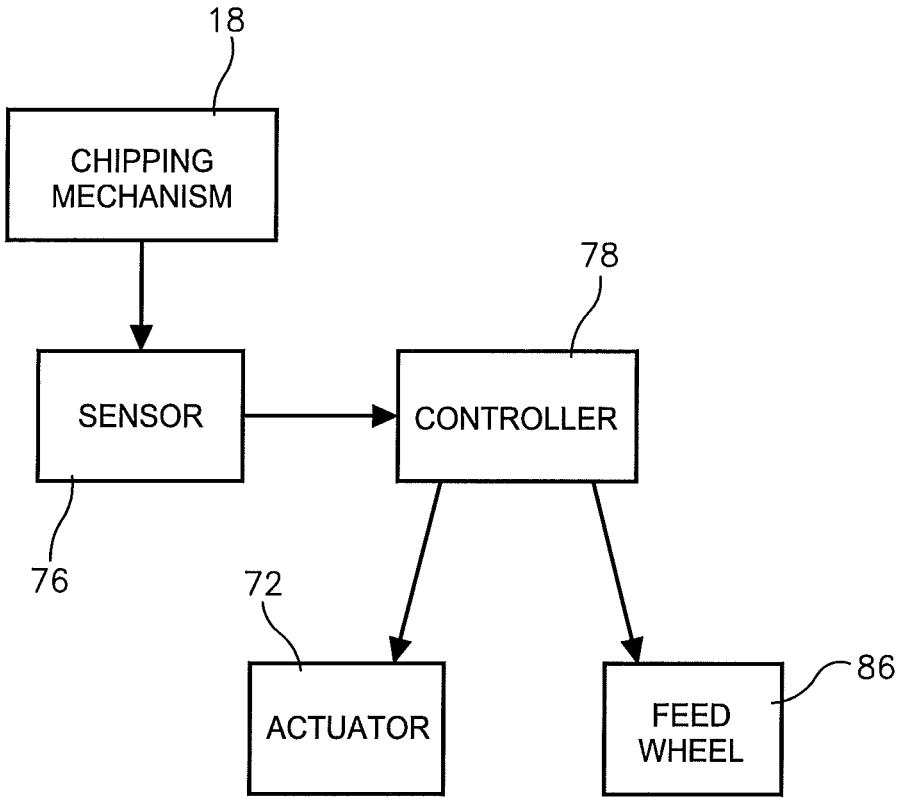
FIG. 11 is a block diagram showing the controller of the woodchipper and related sensor, actuator and feed wheel and particularly illustrating the operating parameter flowing to and instructions flowing from the controller.

Referring to FIGS. 3, 4, and 11, the feed system 22 broadly comprises a material-interface member 70 for feeding material into the chipping mechanism 18; an actuator 72 for moving the material-interface member to a plurality of positions; a feed power source 74 for driving the material-interface member and powering the actuator; a panic bar 75 for disabling the feed power source; a sensor 76 for measuring an operating parameter of the woodchipper 10; and a controller 78 for receiving at least one signal from the sensor, and in response to the received signal, instructing positioning of the material-interface member. The feed system 22 is positioned between the feed horn 34 and the chipping mechanism 18 and operates to feed material from the feed horn and to the chipping mechanism. As can be appreciated, woodchippers can be extremely dangerous to users, and therefore, woodchipper design strives to prevent users from using their own power and force to feed material into the chipping mechanism. The feed system 22 assists with this goal by pushing the material along the inlet path and towards the chipping mechanism 18.

The material-interface member 70 of the feed system 22 comprises a housing 80 including a lower pivot housing 82 and an upper pivot housing 84, and a feed wheel 86 mounted within the housing 80. The lower pivot housing 82 has two ends, with a first end 88 being proximal the feed inlet 14 and a second end 90 being proximal the chipping mechanism 18. The lower pivot housing 82 is comprised of a top 92, a base 94, and two notched sidewalls 96. The top 92 of the lower pivot housing 82 has a substantial cutout leaving only a pair of smaller top surfaces. A first top surface is proximal the first end 88, and a second top surface is proximal the second end 90 of the lower pivot housing 82. The sidewalls 96 are integrally attached, welded, or otherwise mechanically coupled to opposing left and right sides of both the base 94 and the top 92 at ninety-degree angles and extend generally vertically upwards from the base to the top. Each sidewall 96 includes a curved-elongated notch 98 and an arm 100. The notches 98 in the sidewalls 96 provide a path for movement of the feed wheel 86 within the housing 80, as discussed in more detail below. The arm 100 of each sidewall 96 extends upwards past the top 92 and at an angle towards the chipping mechanism 18. As discussed further below, the arms 100 partially serve as mounting structure for the upper pivot housing 84. An angled guide plate 102 is located between the arms 100 and deflects material from touching an outside of the upper pivot housing 84.

The upper pivot housing 84 is configured to be coupled with the lower pivot housing 82. The upper pivot housing 84 includes a top cover 104 shaped like an inverted V and opposing left and right generally U-shaped flanges 106 that each presents an elongated notch. The top cover 104 of the upper pivot housing 84 has a first end proximal the feed inlet 14, and a second end proximal the chipping mechanism 18. The first end of the top cover 104 has a pair of slits 108 on opposing left and right sides. The slits 108 are shaped to receive but not permanently attach to the arms 100 of the sidewalls 96 of the lower pivot housing 82. The second end of the top cover 104 is pivotably coupled to the top surface of the lower pivot housing 82 proximal the chipping mechanism 18.

The flanges 106 of the upper pivot housing 84 extend parallel to and cover a portion of the sidewalls 96 of the lower pivot housing 82. The flanges 106 are integrally attached, welded, or otherwise mechanically coupled to opposing left and right sides of the top cover 104 at a ninety-degree angle and extend generally vertically downwards from the top cover. The notches on each flange provide a pair of mounting points 110 for the feed wheel 86. The flanges 106 cover enough of the sidewalls 96 so that when the support structure is pivoted distally from the lower pivot housing 82 and the drum 42 of the chipping mechanism 18, the flanges 106 still cover the sidewalls 96 of the lover pivot housing 82. On each flange 106 is a secondary mount 112 for coupling to the lower pivot housing 82 by a spring 114. These secondary mounts 112 are located between the pivot point and the feed inlet 14 so that each spring 114 maintains the upper pivot housing 84 a pre-set proximate distance to the lower pivot housing 82.

The feed wheel 86 is generally cylindrical in shape with a drive axle 116 oriented through opposing left and rights ends of the cylinder. The feed wheel 86 is rotatably secured in the upper pivot housing 84 by way of its drive axle 116. In particular, the drive axle 116 is attached to the two mounting points 110 of the downwardly extending flanges 106. The curved surface of the feed wheel 86 is oriented to rotate down towards the lower pivot housing 82 and onward towards the chipping mechanism 18. The feed wheel 86 is positioned by the upper pivot housing 84 a proximate distance to the lower pivot housing 82 to facilitate contact with material as the material is guided from the feed inlet 14 and to the chipping mechanism 18. In embodiments of the invention, the feed wheel 86 further comprises a plurality of protrusions or raised portions arranged in an array on the curved surface to better grip the material being fed. The feed wheel 86 is powered by the feed power source 74 and is operably connected thereto.

Figure 10:
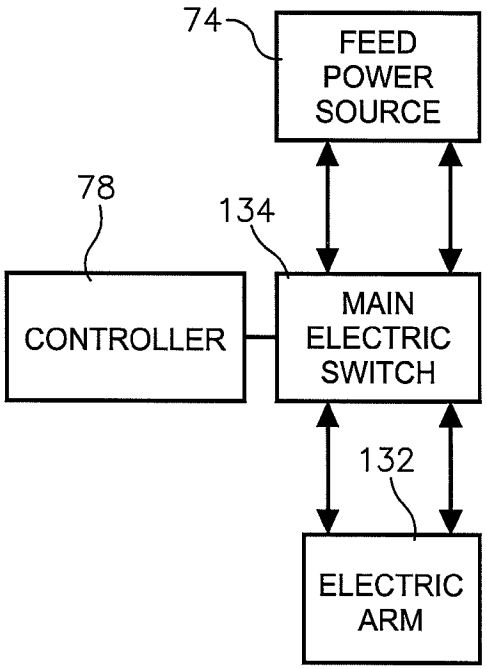
FIG. 10 is a block diagram of one embodiment of the actuator and related controller of the feed system of the woodchipper.
Figure 9:
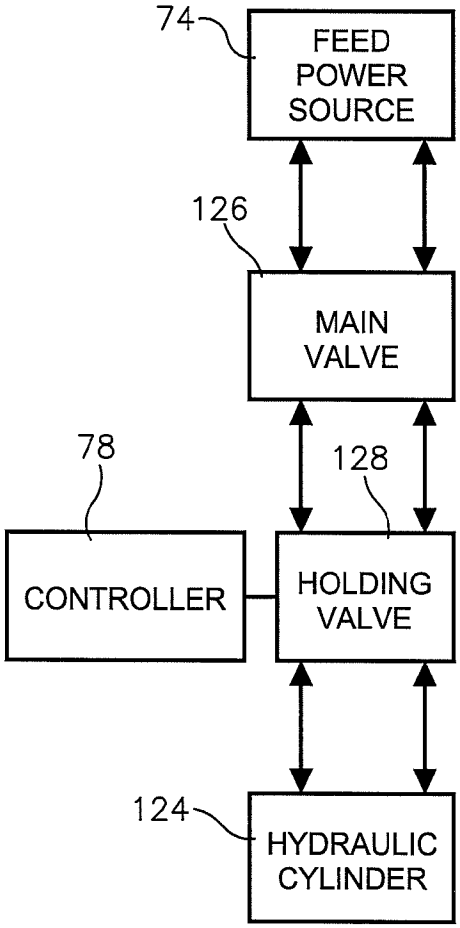
FIG. 9 is a block diagram of one embodiment of the actuator and related controller of the feed system of the woodchipper.
Figure 8:
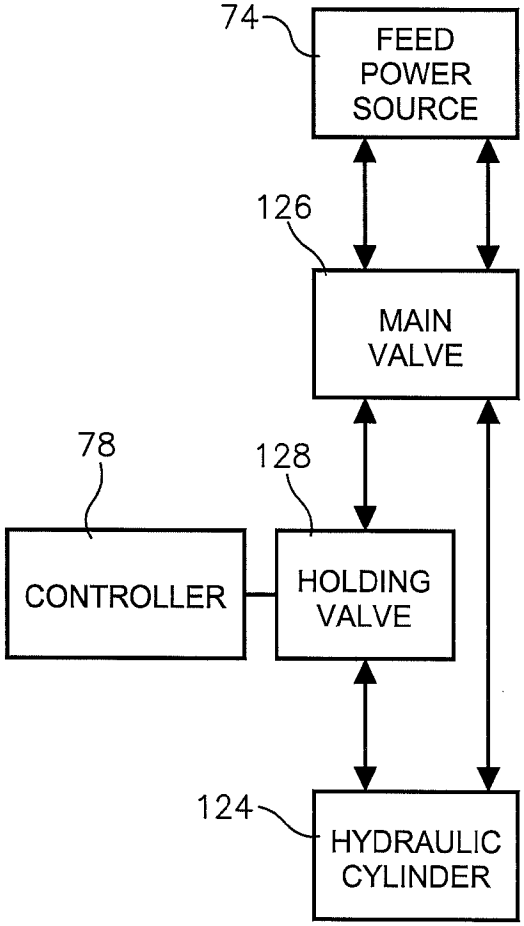
FIG. 8 is a block diagram of one embodiment of the actuator and related controller of the feed system of the woodchipper.

Referring now to FIGS. 8-10, the actuator 72 of the feed system 22 is comprised of a fixed end 118, a feed end 120, and an arm 122 operable to extend and retract to a plurality of lengths between the fixed and feed ends of the actuator. The fixed end 118 is coupled to the drum housing 40 of the chipping mechanism 18, but in other embodiments, the fixed end may be coupled to the frame 12 of the woodchipper 10. The feed end 88 is coupled to the upper pivot housing 84 of the material-interface member 70. Both the fixed 118 and feed ends 120 are pivotable, which allows the actuator 72 to be positioned at a plurality of angles with respect to the woodchipper 10 as the arm 122 extends and retracts. The plurality of lengths of the arm 122 corresponds to the plurality of positions of the material-interface member 70 of the feed system 22. Generally the plurality of lengths may be referred to as extended when the actuator 72 is at its maximum length and may be referred to as retracted when the actuator is at its minimum length.

In embodiments of the invention the actuator 72 is a hydraulic cylinder 124 comprising a piston, a head side of the piston, and a rod side of the piston. The hydraulic cylinder 124 is powered by the feed power source 74 and is operatively connected to the controller 76 of the feed system 22. In embodiments the hydraulic cylinder 124 operates in conjunction with a two-way main valve 126 and a one-way holding valve 128. The main valve 126 is inline from the feed power source 74 to the hydraulic cylinder 124 to control hydraulic fluid from the feed power source. The main valve 126 is hydraulically coupled to direct hydraulic fluid to the rod side of the piston or the head side the piston to thus retract or extend the hydraulic cylinder 124. The holding valve 128 is hydraulically coupled in-line between the main valve 126 and the head side of the piston such that the holding valve can override the main valve from extending the hydraulic cylinder 124. The holding valve 128 is operatively connected to the controller 76 of the feed system 22.

In other embodiments, the holding valve 128 is a two-way holding valve 130 hydraulically coupled on one end to the two lines of the main valve 126. The two-way holding valve 130 is also hydraulically coupled on the other end to the rod side and the head side of the hydraulic cylinder 124 such that the two-way holding valve can override the main valve 126 from extending or retracting the hydraulic cylinder.

In yet further embodiments of the invention, the actuator 72 comprises an electric arm 132 that may extend and retract, a set of power lines, and a main electric switch 134 operatively connected to the controller 76 of the feed system 22. The electric arm 132 receives power from the feed power source 74 by way of the power lines. The main electric switch 134 is coupled in-line between the feed power source 74 and the electric arm 132. The electric switch 134 may send signals to the electric arm 132 to extend or retract. In other embodiments, the electric arm 132 works in conjunction with a holding switch (not shown) operatively connected to the controller 76 of the feed system 22.

When the actuator 72 extends and retracts the actuator moves the feed wheel 86 and the upper pivot housing 84 of the material-interface member 70 about the plurality of positions. The plurality of positions of the feed wheel 86 generally extends vertically and then horizontally with respect to the lower pivot housing 82. When the actuator 72 is retracted the feed wheel 86 is at a position distal to the lower pivot housing 82 and proximal the feed inlet 14. As the actuator 72 starts to extend the feed wheel generally moves downward vertically towards the lower pivot housing 82. This movement helps the actuator 72 place the feed wheel 86 in a position for the feed wheel to pull in the material by rotation. As the actuator 72 continues to extend, the feed wheel 86 also moves away from the feed inlet 14 and towards the chipping mechanism 18. As the actuator 72 approaches its maximum length, the feed wheel 86 is predominately moving horizontally towards the chipping mechanism 18. This predominately horizontal movement helps the feed wheel 86 maintain an interfacing position with the material.

The feed power source 74 of the feed system 22 comprises a power converter 136 to convert power from the auxiliary drive system 68 into power usable by the actuator 72 and the feed wheel 86; a feed wheel motor 138 to power the rotation of the feed wheel; and lines for the transfer of power. In embodiments the lines for the transfer of power are hydraulic lines and the feed wheel motor 138 is a hydraulic motor. In other embodiments the lines for the transfer of power are electrical lines and the feed wheel motor 138 is an electric motor.

The panic bar 75 of the feed system 22 comprises a lever 150 and a valve 152 indirectly connected to the lever. The lever 150 of the panic bar 75 generally runs along the outside of the feed horn 34. The lever is located near the feed inlet end 24 of the woodchipper 10 on every side except the bottom 38 of the feed horn 34. This placement allows an operator to reach the lever 150 anytime the operator is near the feed inlet end 24 of the woodchipper 10. The lever 150 rotates forward and down towards the feed horn 34, and may be pulled or pushed by an operator.

The valve 152 of the panic bar 75 is coupled in-line between the auxiliary drive system 68, and the actuator 72 and the feed wheel 86 of the feed system 22. The valve 152 is also connected to the lever 150 through a one-way linkage (not depicted). The valve 152 has a first position that allows power flow and a second position that denies power flow. During normal operation the valve 152 is in the first position and the auxiliary drive system 68 routes power to the rest of the feed system 22.

When the lever 150 of the panic bar 75 is pulled or pushed, the one-way linkage moves the valve 152 into the second position directing power away from the auxiliary drive system 68. In this second position the flow of power to the actuator 72 and the feed wheel 86 is stopped, thus the feed system 22 no longer operates. Because the valve 152 is connected through the one-way linkage, subsequent pulling or pushing on the lever 150 will not restart the feed system 22. Only by first resetting the lever 150 and then directly resetting the valve 152 to the first position will the feed system 22 continue to operate.

The sensor 76 of the feed system 22 for measuring an operating parameter of the woodchipper 10 comprises a metallic toothed sprocket 140 attached to the drum 42 of the chipping mechanism 18 such that the sprocket rotates with the drum. The sensor 76 further comprises a pickup (not depicted) mounted on the frame 12 of the woodchipper 10 that reads the rotation of the sprocket 140 and thus rotation of the drum 42. In embodiments of the invention, the pickup may be mounted on or otherwise associated with the drum housing 40 of the chipping mechanism 18.

In embodiments of the invention, the sensor 76 may comprise only a pickup. This pickup may be an optical camera that visually measures rotation of the drum 42, a caster to physically measure rotation of the drum, or any other device appreciable to measure rotation of the drum of the chipping mechanism 18. In embodiments, the pickup measures force and is connected to the actuator 72 of the feed system 22 to measure the force the actuator exerts upon the upper pivot housing 84. In other embodiments, the sensor 76 may measure status of the power source 20 of the woodchipper 10. In embodiments of the invention, there may be a plurality of sensors 76 measuring multiple operating parameters of the woodchipper 10.

The controller 78 of the feed system 22 broadly comprises a processor having an associated non-transitory computer-readable storage medium for storage of a computer program comprising a plurality of code segments for implementing at least the following sets of control logic: a set of logic to receive signals from the sensor of the feed system 502; a set of logic to establish a normative operating value for the operational parameter 504; a set of logic to compare the operational parameter to a normative operating value 506 (herein "logic to compare"); a set of logic to instruct the feed wheel 508; and a set of logic to instruct the actuator 510.

The controller 78 may execute computer programs, software, code, instructions, algorithms, applications, or firmware, and combinations thereof. The controller may include processors, microprocessors, microcontrollers, field-programmable gate arrays (FPGAs), application-specific integrated circuits (ASICs), combinations thereof, and the like, and may be implemented using hardware description languages (HDLs), such as Verilog and VHDL. The controller may further include data storage components, which may comprise "computer-readable media" capable of storing the computer programs, software, code, instructions, algorithms, applications, or firmware. The computer-readable media may include random-access memory (RAM) such as static RAM (SRAM) or dynamic RAM (DRAM), cache memory, read-only memory (ROM), flash memory, hard-disk drives, compact disc ROM (CDROM), digital video disc (DVD), or Blu-Ray™, combinations thereof, and the like.

The controller may be connected to ancillary systems. The systems may further include components not shown in the figures, such as inputs, outputs, and communication ports. Inputs may include knobs, dials, switches, levers, stop bars, panic bars, combinations thereof, and the like. Outputs may include warning buzzers, lights, gauges, meters, combinations thereof, and the like. Communication ports may be wired or wireless, electronic, optical, radio frequency (RF), combinations thereof, and the like.

Figure 6:
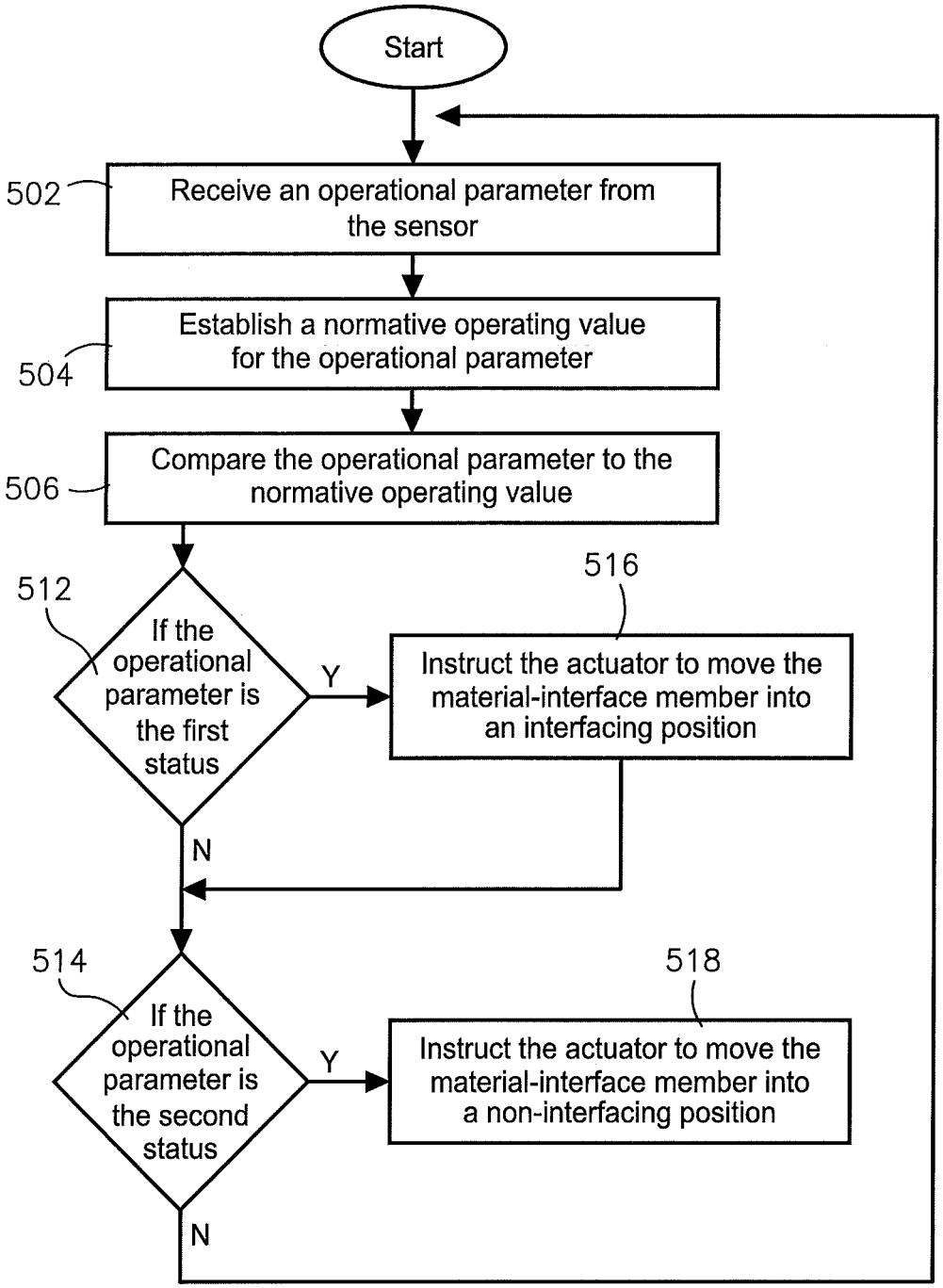
FIG. 6 is a flow chart of the logic of the controller of the woodchipper.

In general and as discussed above, embodiments of the invention receive from the sensor information indicative of an operational parameter of the woodchipper, as set forth in Step 502 of FIG. 6. A normative operating value is pre-established, as set forth in Step 504. The controller 78 compares the operational parameter to the pre-established normative operating value, as set forth in Step 506. Based on the comparison, the controller instructs a particular operation of the material-interface member (which in embodiments is the feed wheel). The operational parameter of the woodchipper may be several different types of values, as discussed below. Similarly, the normative operating value may be several different types of values. Depending on the type of value for the operational parameter, the sensor may sense various types of operating signals, as discussed below.

The steps discussed above, and all of the logic set forth in FIG. 6, occur at a time T1. In embodiments of the invention, at a time T2, which occurs after time T1, all of the steps set forth in FIG. 5 also occur. The time may be seconds, milliseconds, or any other timeframe that may be considered continuous.

In embodiments of the invention, the sensor 76 senses the speed of the drum 42 of the chipping mechanism 18, such that the controller 78 receives, as the operational value, the speed of the drum of the chipping mechanism. In other embodiments, the sensor 76 senses a pickup monitoring the force exerted by the actuator 72 of the feed system 22, a power consumption of the power source 20, or a resistance of the feed wheel 86. One or more sensors 76 may be used to sense the operational parameter, and reference herein to a single sensor is defined to include one or more sensors.

As noted above, the controller 78 receives an operational parameter from the sensor 502. In embodiments, the operational parameter may be a value sensed by the sensor 76. In other embodiments, the operational parameter may be a value calculated by the controller 78 using the information received by the sensor 76. Reference to an operational parameter herein is intended to include both the operational parameter value itself or information indicative of the operational parameter or used to calculate the operational parameter. In embodiments, the operational parameter may be a speed of the chipping mechanism 18, an acceleration of the chipping mechanism 18, a force of the actuator 72, or a load on the feed wheel 86 of the feed system 22.

The controller 78 is programmed to compare the operational parameter to the normative operating valve 506, determine if the operational parameter is a first status or determine 512 or if the operational parameter is a second status 514 and thus determine a status of the woodchipper 10, and instruct the feed system 22 based on the determined status. A first status 512 corresponds to the woodchipper 10 operating properly, whereas a second status 514 indicates that the woodchipper 10 is having difficulty operating. As can be appreciated, the controller 78 could be programmed with inverse logic, such that the first status 512 indicates that the woodchipper 10 is having difficult operating, and the second status 514 indicated that the woodchipper 10 is operating properly.

As set forth below, the first status and the second status of the operational parameter are pre-defined statuses that the controller 78 uses to determine if the woodchipper 10 is operating properly or improperly, respectively. The controller is able to determine a first status or a second status by a comparison between the operational parameter and the normative operating value. Thus, any reference to first status and second status herein means the result of a comparison between the operational parameter and the normative operating value. Likewise, any statement indicating that the woodchipper 10 is operating at a first status or a second status herein means a result of the comparison between the operational parameter and the normative operating value indicates to the controller 78 that the woodchipper is operating properly or improperly.

In embodiments of the invention, the normative operating value is a threshold or preferred value for the operational parameter, such as a threshold negative acceleration of the drum 42, a maximum force exerted by the actuator 72 on the material, or a preferred range of speeds of the drum. Thus, if the operational parameter is the speed of the chipping mechanism 18, then the normative operating value may be a threshold minimum speed of the chipping mechanism. If the sensed speed of the chipping mechanism 18 is above the normative operating value, i.e., the pre-set threshold minimum speed of the chipping mechanism, then the controller 78 may determine that the woodchipper 10 is operating at a first status 512. Alternatively, if the sensed speed of the chipping mechanism 18 is at or below the normative operating value, then the controller 78 may determine that the woodchipper 10 is operating at a second status 514. It should be appreciated that the controller 78 could be programmed for various delineations between the first 512 and second status 514. For example, if the sensed speed of the chipping mechanism 18 is equal to the normative operating value, the controller 78 could be programmed to indicate a first status 512. In yet further alternatives, the controller 78 could be programmed with a range of values corresponding to the normative operating value, such that the normative operating value is not a single value. In some embodiments, a tolerance may be applied to the compared operational parameter and normative operating value, such that an operational parameter within a certain percentage of the normative operating value indicates one of the first 512 and second statuses 514, and an operational parameter outside a certain percentage of the normative operating value indicates the other of the first and second statuses. For example, if the operational parameter is within 1%, 3%, 5%, or 10% of the normative operating value, the first status 512 is indicated. Again, it should be appreciated that in each of the above scenarios, the controller 78 could be programmed with inverse logic.

To further define exemplary determinations using various operational parameters, the controller 78 determines that the woodchipper is operating at a first status 512 if the speed of the drum 42 of the chipping mechanism 18 is (1) above a preferred speed that is otherwise pre-set (i.e., pre-programmed); (2) equal to the preferred drum speed; or (3) within a preferred range of drum speeds. In yet further embodiments, the controller 78 determines a first status 512 if the negative acceleration of the drum 42 is less than the threshold negative acceleration. In embodiments where the operational parameter is the force exerted by the actuator 72, the controller 78 determines a first status 512 if the force exerted by the actuator is below a maximum force. The controller 78 determines that the woodchipper is operating at a second status 512 if the speed of the drum 42 of the chipping mechanism (1) is below a preferred, pre-set speed; (2) if the negative acceleration of the drum is greater than the threshold negative acceleration; (3) if the force exerted by the actuator 72 is greater than the maximum force; or (4) if the speed of the drum is outside a preferred range of speeds.

The controller 78 is programmed to instruct operation of the feed wheel 508 and operation of the actuator 510. The controller 78 instructs the feed wheel 508 by having the feed wheel 86 begin pulling in the material to be chipped. Additionally, embodiments of the invention include instructing the feed wheel 508 in any of the following ways: instructing a backward or a forward direction of rotation of the feed wheel 86 corresponding to rotating the bottom of the feed wheel towards the feed inlet end 24 or the material outlet end 26 of the woodchipper 10; instructing the amount of force exerted by the feed wheel onto the material; and instructing the speed at which the feed wheel rotates. The controller 78 in some embodiments does not instruct the feed wheel 508; instead, the feed wheel 86 constantly pulls material into the drum 42 of the chipping mechanism 18. In yet other embodiments of the invention, the feed system 22 may comprise multiple controllers 78, a first controller to instruct the actuator 72 and a second controller to instruct the feed wheel 86. In embodiments of the invention discussed below, the controller 78 instructs the feed wheel 508 based on determinations made by the controller (512, 514).

When, as explained above, the controller 78 determines that the woodchipper is operating at a first status 512, the controller instructions 508 may comprise (1) instructing a forward rotation of the feed wheel 86; (2) maintaining the force applied by the feed wheel; (3) increasing the force applied by the feed wheel; (4) increasing the speed of the feed wheel; or (5) maintaining the speed of the feed wheel. These instructions have the effect of pulling material towards the material outlet end 26 of the woodchipper 10 and into the chipping mechanism 18. When the controller 78 determines that the woodchipper is operating at a second status 514, the controller instructions may comprise (1) instructing a backward rotation of the feed wheel 86; (2) stopping rotation of the feed wheel; (3) decreasing the force applied by the feed wheel; or (4) decreasing the speed of the feed wheel. These instructions have the effect of pulling material towards the feed inlet end 24 of the woodchipper 10 and away from the chipping mechanism 18, or stopping the material from being pulled into the chipping mechanism.

Further embodiments of the invention include the controller 78 transmitting multiple instructions when the controller determines that the woodchipper is a first status 512. By way of example, if the controller 78 determines the woodchipper is a first status 512, the controller instructs the feed wheel 508 to maintain speed and increase force applied by the feed wheel 86. The inverse is also true when the controller 78 determines the woodchipper is a second status 514. If the controller 78 determines the woodchipper is a second status 514, the controller may instruct the feed wheel 508 to decrease speed and also decrease force applied to the material. In embodiments of the invention, the controller 76 may instruct the feed wheel 508 indirectly by instructing the feed power source 74 how much power to provide to the feed wheel 86.

The logic to instruct the operation of the actuator 510 is programmed to instruct the actuator to move the material-interface member into an interfacing position 516 and a non-interfacing position 518 with respect to the material to be chipped. As described herein, instructing the actuator to move the material-interface member into an interfacing position 516 includes the following positions or operation of the material-interface member 70: the material-interface member touching the material, pushing the material (including applying pressure against the material), or resting against the material; or moving the material-interface member downwards and towards the material. In contrast, instructing the actuator to move the material-interface member into the non-interfacing position 518 includes the following positions or operation of the material-interface member 70: the material-interface member not touching the material, no longer pushing the material (including no longer applying pressure against the material), or not resting against the material; ceasing movement, including ceasing downward movement, of the material-interface member; or moving the material-interface member upwards and away from the material.

When, as explained above, the controller 78 determines that the woodchipper is a first status 512 the controller instructs the actuator to move the material-interface member into an interfacing position 516. These instructions have the effect of pulling material towards the material outlet end 26 of the woodchipper 10 and into the chipping mechanism 18. When, the controller 78 determines that the woodchipper is a second status 514 the controller instructs the actuator to move the material-interface member into a non-interfacing position 518. These instructions have the effect of pulling material towards the feed inlet end 24 of the woodchipper 10 and away from the chipping mechanism 18, or stopping the material from being pulled into the chipping mechanism.

Operation and use of the woodchipper 10 will now be described in greater detail. An operator places the woodchipper 10 in an operating position by first unlatching the feed table 36 and rotating it downwards approximately 90 degrees, such that the feed table is generally parallel with a bottom side of the feed horn 34. In embodiments where the material outlet 16 comprises a rotatable connection to the upper drum housing 48 of the chipping mechanism 18, the operator directs the chute 56 of the material outlet towards a receptacle or safe area for chipped material to land. The upper pivot housing 84 and feed wheel 86 of the feed system 22 begin in a resting state a proximate distance to the lower pivot housing 82.

Next, the power component 62 of power source 20 is activated. The activation of the power component 62 also activates the auxiliary drive system 68. Activation of the auxiliary drive system 68 powers the feed power source 74 and thus the controller 78 of the feed system 22. The operator then activates the main drive system 66 to power on the chipping mechanism 18. In embodiments of the invention where there is no clutch, the activation of the power component 62 may also activate the main drive system 66 and thus the chipping mechanism 18. In embodiments, the activation of the feed power source 74 of the feed system 22 may be by way of the auxiliary drive system 68 or the main drive system 66. In embodiments, there is only a main drive system 66 directly powering the chipping mechanism 18 and the feed system 22 and any accessories.

The controller 78 of the feed system 22 begins receiving signals from the sensor 76 of the feed system 22, such as the speed of the drum 42 of the chipping mechanism 18, and either records the received signals as a received operational parameter or calculates the operational parameter using the information received from the sensor. In embodiments of the invention using multiple sensors 76, the controller 78 calculates either a single or multiple operational parameters of the woodchipper 10. The controller 78 then compares the operational parameter, in this case the speed of the drum 42, to a normative operating value, such as a minimum speed at which the drum should rotate.

The operator then begins to feed material to be chipped into the feed horn 34 and pushed on the material until the feed wheel 86 of the feed system 22 engages the material. As the operator pushes the material, the upper pivot housing 84 and feed wheel 86 of the material-interface member 70 of the feed system 22 move upwards allowing the material to pass into the material-interface member. As the upper pivot 84 moves upward, the arms 100 of the notched sidewalls 96 of the lower pivot housing 82 stay inside of the slits 108 of the top cover 104 of the upper pivot housing 82. As will happen later in operation as described below, when the upper pivot housing 82 moves down, the arms 100 and slits 108 will help align the U-shaped flanges 106 of the upper pivot housing 84 over the sidewalls 96 of the lower pivot housing 82.

Upon the controller 78 of the feed system 22 sensing upward movement of the upper pivot housing 84 and mounted feed wheel 86, the controller instructs the feed wheel to move downwards towards the lower pivot housing 82 so that the feed wheel contacts the material. The rotation of the feed wheel 86 pulls the material inside the material-interface member. In embodiments, the feed wheel 86 is already rotating in a manner to pull material inside the material-interface member 70 and needs no initiating instruction from the controller 78.

Once part of the material is inside and begins being pulled by the feed wheel 86, the springs 114 connecting the upper pivot housing 84 and the lower pivot housing 82 keep the feed wheel touching the top of the material. In embodiments of the invention, the weight of the upper pivot housing 84 and feed wheel 86 keep the feed wheel in contact with the material. The controller 78 of the feed system 22 may also instruct the actuator 72 to extend with a minimal force to keep the feed wheel 86 contacting the top of the material. The bottom of the material is also contacted by the lower pivot housing 82 and sidewalls 96 and slides towards the chipping mechanism 18 based on motivation from the feed wheel 86.

Once fed to the chipping mechanism 18, the material inside the material-interface member 70 passes through the drum housing 40 of the chipping mechanism and reaches the rotating drum 42. The plurality of chipping implements 44 on the drum 42 chip the material into small pieces of chipped material. The rotation of the chipping implements 44 also throws chipped material up into the upper drum housing 48 to the funnel 50 and out the chute 56 of the material outlet 16. As the drum 42 of the chipping mechanism 18 forces the chipping implements 44 into contact with the material, the feed wheel 86 continues to rotate. This rotation brings in more of the material to be chipped.

In embodiments of the invention, the chipping of material by the drum 42 slows the drum's rotation. The controller 78 is continuously receiving the signals of the sensor and calculating an operational parameter 502 of drum speed. The controller 78 also continuously compares the operational parameter to the normative operating value 506. The normative operating value is an ideal speed of the drum 42. If the drum speed falls below the ideal speed, the controller 78 instructs the feed wheel 86 to stop rotating and thus stop feeding in material to the drum 42. In embodiments, the controller 78 instructs the feed wheel 508 to slow its rate of rotation and thus, the rate at which material is fed into the drum 42 of the chipping mechanism 18. In other embodiments, the controller 78 instructs the feed wheel 508 to reverse direction for a few milliseconds or a second and then the controller instructs the feed wheel to stop.

Once the drum 42 stops chipping the material, the power source 20 can accelerate the drum to a faster speed. Meanwhile, the controller 78 still receives signals from the sensor and calculates the speed of the drum (502, 504). The controller also continues to compare the drum's speed to a normative operating value 506. When the speed of the drum is above the ideal speed, the controller 78 instructs the feed wheel 86 to resume rotation to feed the material into the drum 42.

Once the rotation of the feed wheel 86 no longer brings material into the drum 42 of the chipping mechanism 18, hydraulic pressure from the hydraulic lines of the feed power source 74 extend the hydraulic cylinder 124 to move the feed wheel into an interfacing position with the material. The controller 78 is still continuously comparing the drum's speed to an ideal speed 506 and determining whether the woodchipper is operating normally (a first status) 512. As long as the controller determines that the speed of the drum 42 is above a normative operating value, the controller 78 instructs the feed power source 74 to keep the holding valve 128 open. By keeping the holding valve 128 open, the feed power source 74 continues to extend the hydraulic cylinder 124. Once the hydraulic cylinder 124 has moved the feed wheel 86 to a proximate distance from the drum 42, the drum's chipping implements 44 can finish pulling in the material as the material is being chipped. At this point the last of the material has been chipped by the drum 42 and flows up and out the funnel 50 of the upper drum housing 48 and out of the chute 56 of the material outlet.

In some situations "wood chock" may occur. Wood chock is defined as where the rotation of the drum 42 of the cutting mechanism 18 cannot chip material fast enough and the material stops the drum or slows the drum to an undesirable speed. Wood chock occurs when the interfacing position of the feed wheel 86 inserts chipped material in a manner that is too fast, too hard, or too much for the drum 42. If the extension of the hydraulic cylinder 124 and thus the feed wheel 86 begins to create a wood chocking situation, the controller 78 of the feed system will sense this and adjust the material-interface member accordingly. The controller 78 compares the speed of the drum 42 to an ideal speed 506. If the speed of the drum 42 of the chipping mechanism is below an ideal speed, the controller determines that the woodchipper is operating at a second status. 514

When the controller 78 of the feed system 22 determines that the woodchipper is a second status 514 and thus unable to keep up with the insertion of chipped material, the controller instructs the holding valve 128 to close. The closing of the holding valve 128 prevents the hydraulic cylinder 124 from continuing to push the feed wheel 86 into the material. This cessation of pushing is a non-interfacing position, and allows the power source 20 to speed up the drum 42 of the chipping mechanism 18. The controller 78 continues to determine if the speed of the drum is below an ideal speed 514. When the speed of the drum 42 is above the ideal speed, the controller determines that the woodchipper is again operating at a first status 512. At this point the controller 78 instructs the holding valve 128 to open again, and the hydraulic cylinder 124 locates the feed wheel into an interfacing position.

The controller 78 continuously receives signals from the sensor, calculates the speed of the feed wheel, establishes a normative operating value, and compares it to an ideal speed (502, 504, 506). "Continuous" as used herein is defined as receiving signals and performing a comparison of the operational parameter to the normative operating value less than every second, every 1 second, every 2 seconds, every 3 seconds, every 5 seconds, or every 10 seconds. The controller 78 will constantly place the feed wheel of the material-interface member into either the interfacing position 516 or the non-interfacing position 518 when the controller determines the speed is a first status 512 or a second status 514, respectively.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A woodchipper comprising:

a feed inlet for receipt of a material to be chipped therethrough;

a material outlet through which the material exits after being chipped;

a chipping mechanism disposed between the feed inlet and the material outlet for chipping the material; and a feed system including— a material-interface member for feeding the material towards the chipping mechanism during operation of the woodchipper, wherein the material-interface member is configured to be moved into an interfacing position with the material, and to a non-interfacing position with the material, wherein the interfacing position is defined by the material-interface member being a first location relative to the chipping mechanism such that the material-interface member can feed the material to the chipping mechanism;

wherein the non-interfacing position is defined by the material-interface member being at a second location relative to the chipping mechanism such that the material-interface member cannot feed the material to the chipping mechanism;

an actuator for moving said material-interface member between said interfacing and non-interfacing positions;

a sensor for detecting information indicative of an operational parameter of the woodchipper; and a controller for controlling operation of the actuator based on said information indicative of an operational parameter detected by the sensor.

2. The woodchipper of claim 1, said controller including a non-transitory computer readable medium having a computer program thereon operable to instruct the controller to implement the following control logic steps:

establishing a normative operating value for the operational parameter;

receiving the information indicative of the operational parameter detected by the sensor;

determining if the operational parameter detected by the sensor is a first status or a second status, wherein the first status and the second status are determined by a comparison between the normative operating value and the operational parameter;

if the operational parameter is the first status, instructing the actuator to move said material-interface member to said interfacing position; and if the operational parameter is the second status, instructing the actuator to move said material-interface member to said non-interfacing position.

3. The woodchipper of claim 2, wherein the first status is that the operational parameter is above the normative operating value and the second status is that the operational parameter is at or below the normative operating value.

4. The woodchipper of claim 2, wherein the second status is that the operational parameter is outside of a range defined by the normative operating value.

5. The woodchipper of claim 2, wherein said step of instructing the actuator to move said material-interface member to said non-interfacing position comprises an instruction to cease movement of the material-interface member.

6. The woodchipper of claim 2, wherein said step of instructing the actuator to move said material-interface member to said non-interfacing position comprises an instruction to move the material-interface member upwards and away from the material.

7. The woodchipper of claim 2, wherein the first status and the second status are determined by a comparison between the normative operating value and the operational parameter and are performed at a time T1, said controller being operable to implement the following additional control logic steps at a time T2 that is after time T1:

repeating said step of determining if the operational parameter detected by the sensor is a first status or a second status, wherein the first status and the second status are determined by a comparison between the normative operating value and the operational parameter;

if the operational parameter is the first status, instructing the actuator to move said material-interface member to said interfacing position; and if the operational parameter is second status, instructing the actuator to move said material-interface member to said non-interfacing position.

8. The woodchipper of claim 2, wherein the operational parameter is a speed of the chipping mechanism, and the normative operating value is a minimum speed of the chipping mechanism.

9. The woodchipper of claim 2, wherein the operational parameter is selected from the group consisting of: a speed of the chipping mechanism, an acceleration of the chipping mechanism, a force exerted by the actuator, a force exerted by the chipping mechanism, a load on an engine that rotates the chipping mechanism, and the amplitude of any vibrations of the woodchipper.

10. The woodchipper of claim 1, wherein the actuator comprises a hydraulically actuated cylinder, wherein the material-interface member is a feed wheel configured to rotate so as to feed the material toward the chipping mechanism while the material-interface member is in the interfacing position.

11. The woodchipper of claim 1, wherein the controller comprises a microprocessor having an associated non-transitory computer-readable storage medium a computer program stored thereon.

12. A woodchipper comprising:

a feed inlet for receipt of material to be chipped therethrough;

a material outlet through which chipped material exits;

a chipping mechanism disposed between the feed inlet and the material outlet and for chipping the material; and a feed system including— a feed wheel for interfacing with the material to feed the material towards the drum during operation of the woodchipper, wherein the feed wheel is configured to be moved into an interfacing position with the material, and to a non-interfacing position with the material, wherein the interfacing position is defined by the feed wheel being a first location relative to the chipping mechanism such that the material-interface member can feed the material to the drum;

wherein the non-interfacing position is defined by the material-interface member being at a second location relative to the chipping mechanism such that the material-interface member cannot feed the material to the drum;

a hydraulic cylinder for moving said feed wheel between said interfacing and non-interfacing positions;

a sensor associated with the woodchipper to detect a rotational parameter of the drum; and a controller for controlling operation of the hydraulic cylinder based on the rotational parameter detected by the sensor, said controller including a non-transitory computer readable medium having a computer program thereon operable to instruct the controller to implement the following control logic steps:

establishing a normative operating value for the rotational parameter;

receiving the rotational parameter detected by the sensor;

determining if the rotational parameter detected by the sensor is a first status or a second status, wherein the first status and the second status are determined by a comparison between the normative operating value and the rotational parameter;

if the rotational parameter is the first status, instructing the hydraulic cylinder to move the feed wheel to said interfacing position; and if the rotational parameter is the second status, instructing the hydraulic cylinder to move the feed wheel to said non-interfacing position.

13. The feed system of claim 12, wherein said step of instructing the actuator to move the feed wheel to said non-interfacing position is an instruction to cease downward movement of the feed wheel toward the material.

14. The feed system of claim 12, wherein said step of instructing the actuator to move the feed wheel to said interfacing position is an instruction to move the feed wheel in a downward direction such that the feed wheel comes into contact with the material.

15. A method for controlling a feed system of a woodchipper, said woodchipper having a feed inlet for receipt of material to be chipped therethrough, a material outlet through which chipped material exits, a chipping mechanism disposed between the feed inlet and the material outlet, a material-interface member disposed between the chipping mechanism and the feed inlet and configured to feed the material to the chipping mechanism, and a power source for the woodchipper, the method comprising the following steps:

receiving an operational parameter of the woodchipper;

establishing a normative operating value for the operational parameter;

determining if the operational parameter is a first status or a second status, wherein the first status and the second status are determined by a comparison between the normative operating value and the operational parameter;

if the operational parameter is the first status, instructing an actuator to move a material-interface member into an interfacing position with the material; and if the operational parameter is the second status, instructing an actuator to move the material-interface member into a non-interfacing position with the material, wherein the interfacing position is defined by the material-interface member being a first location relative to the chipping mechanism such that the material-interface member can feed the material to the chipping mechanism, wherein the non-interfacing position is defined by the material-interface member being at a second location relative to the chipping mechanism such that the material-interface member cannot feed the material to the chipping mechanism.

16. The method of claim 15, wherein the operational parameter is selected from the group consisting of: a velocity of the chipping mechanism, an acceleration of the chipping mechanism, a force exerted by the actuator, and a load on the power source.

* * * * *